US005131824A

United States Patent [19]

Richardson, Jr. et al.

[11] Patent Number: 5,131,824

[45] Date of Patent: Jul. 21, 1992

[54] OLDHAM COMPRESSOR

[75] Inventors: Hubert Richardson, Jr., Brooklyn; George W. Gatecliff, Saline, both of Mich.

[73] Assignee: Tecumseh Products Company, Tecumseh, Mich.

[21] Appl. No.: 651,473

[22] Filed: Feb. 6, 1991

[51] Int. Cl.[5] ..... F04B 21/04

[52] U.S. Cl. ..... 417/526; 464/102

[58] Field of Search ..... 417/523, 525, 526; 464/102; 418/55.3

[56] References Cited

U.S. PATENT DOCUMENTS

| | | | |
|---|---|---|---|
| 1,622,816 | 3/1927 | Sperry | 417/463 |
| 1,867,198 | 7/1932 | Waite | 417/221 |
| 2,574,921 | 11/1951 | Johnson | 103/160 |
| 3,262,393 | 7/1966 | Allen | 417/526 |
| 4,137,022 | 1/1979 | Lassota | 418/1 |
| 4,637,786 | 1/1987 | Matoba et al. | 464/102 |
| 4,655,696 | 4/1987 | Utter | 464/102 |
| 4,679,994 | 7/1987 | Brown | 417/525 |
| 4,875,838 | 10/1989 | Richardson, Jr. | 418/55.4 |

FOREIGN PATENT DOCUMENTS 61-11488 1/1986 Japan .

*Primary Examiner*—Richard A. Bertsch
*Assistant Examiner*—Charles Freay
*Attorney, Agent, or Firm*—Baker & Daniels

[57] ABSTRACT

The present invention is a compressor using an Oldham-type assembly functioning as a piston to provide a compressing pump. An orbiting plate is eccentrically mounted on the crankshaft, and a compressing pump body is fixed within the interior of the housing. An Oldham piston is disposed within the compressing pump and has tabs which engage slots on the orbiting plate. The side walls of the pump body prevent movement of the Oldham piston in a first direction so that the orbiting of the plate causes the piston to reciprocate in a second, orthogonal direction. Suction valves on the piston control entry of refrigerant into the compressing pump, and discharging valves control refrigerant discharge.

28 Claims, 1 Drawing Sheet

OLDHAM COMPRESSOR

BACKGROUND OF THE INVENTION

The present invention relates to compressors. More specifically, the field of the invention is that of compressors using an Oldham-type mechanism for compressing refrigerant fluid.

One type of compressor design is a scroll-type compressor which uses an Oldham ring in the compression mechanism. Scroll-type compressors are well known, for example, the scroll compressor disclosed in U.S. Pat. 4,875,838, the disclosure of which is expressly incorporated by reference. A typical scroll compressor comprises two facing scroll involute wraps which interfit to define a plurality of closed pockets. When one of the scroll wraps orbits relative to the other, the pockets travel between a radially outer suction port and a radially inner discharge port to convey and compress refrigerant fluid.

Oldham rings are used in such compressors to cause the movable scroll wrap to orbit within the fixed scroll wrap and thereby compress refrigerant. The Oldham ring conventionally has an annular body with tabs for engaging slots on the underside of the movable scroll wrap and on a portion of the compression mechanism which fixed to the housing. The movable scroll wrap is rotatably connected to a hub which is eccentric to the axis of the crankshaft. When the driving mechanism of the compressor operates, and rotates the crankshaft, the movable scroll wrap is prevented from rotating by the engagement of tabs and slots and therefore orbits within the fixed scroll wrap. This conventional Oldham-type assembly causes the movable scroll wrap to intermesh with the fixed scroll wrap to form pockets and compress refrigerant.

SUMMARY OF THE INVENTION

The present invention is a compressor using an Oldham-type assembly to provide a compressing pump which is less costly to manufacture. The Oldham-type assembly restricts movement in a first direction, so that a piston reciprocates in a second direction which is transverse to the first direction. Suction valves control entry of refrigerant into the compressing chambers, and discharge valves control the exiting refrigerant. With this structure, rotational movement is converted to line a movement in the second direction for pumping of the refrigerant.

To cause the piston to reciprocate, a simplified Oldham-type assembly is used. An orbiting plate is eccentrically mounted on the eccentric of the compressor crankshaft, and a compression pump body is fixed within the interior of the compressor. The piston is movable in a first direction on the orbiting plate, and the pump body guides the movement of the piston in a second direction which is transverse to the first. The piston reciprocates within the pump body in the second direction when the orbiting plate The present invention is, in one form, a compressor comprising a housing, an orbiting plate, a driving device, a compressing chamber, a piston, and valves. The hermetically sealed housing includes an inlet and an outlet. The orbiting plate is disposed within the housing and the driving device causes the orbiting plate to orbit. The compressing chamber is fixedly attached to the housing. The piston is a compressing device which compresses refrigerant in the compressing chamber by slidably engaging the orbiting plate for relative rectilinear movement in a first direction. The piston is disposed within the compressing chamber and is movable within the compressing chamber in a second direction, which is perpendicular to the first direction. The piston is keyed to the orbiting plate to be driven by the orbiting plate in the second direction, so that the piston moves in the second direction when the driving means causes the orbiting plate to orbit. Additionally, the compressor includes valves for selectively providing fluid communication between the inlet and the piston device, as well as between the piston device and the outlet.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention and such exemplification is not to be construed as limiting the scope of the invention in any manner.

DESCRIPTION OF THE PREFERRED EMBODIMENT

Figure 1:
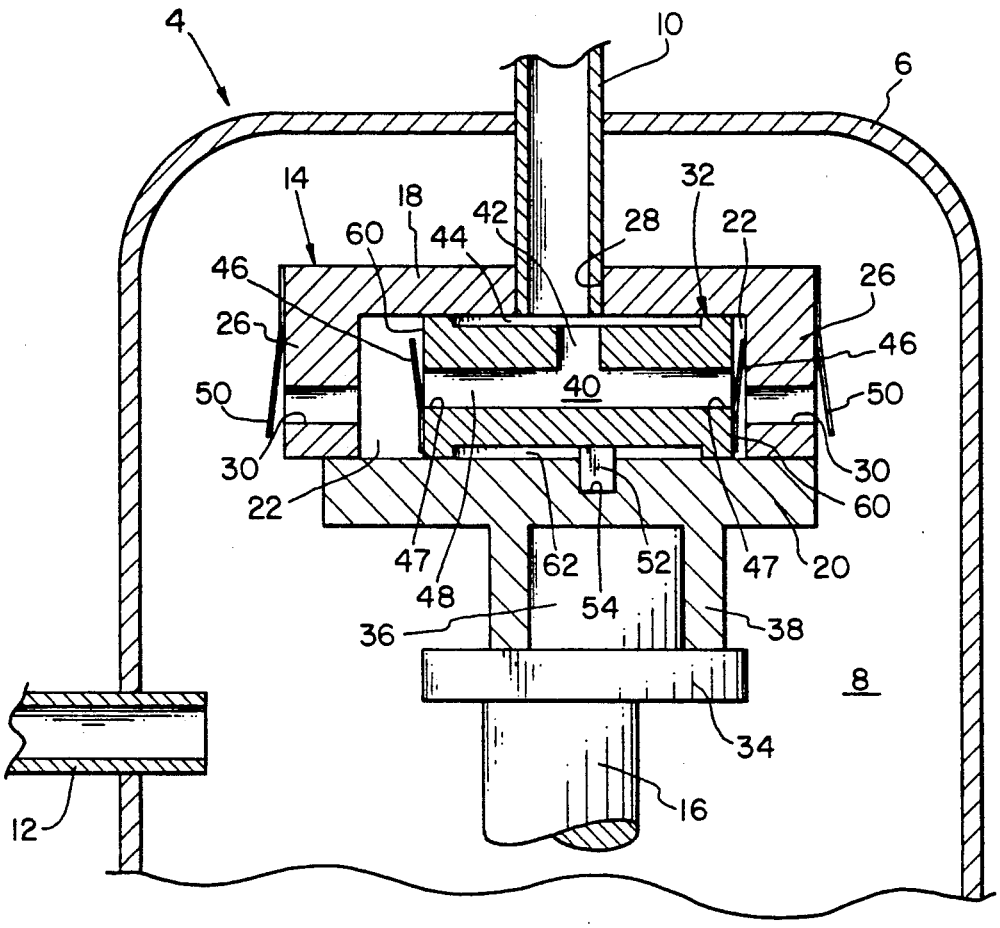
FIG. 1 is an elevational view, in partial cross-section, a compressor of the present invention.

The present invention involves compressor 4 as shown in FIG. 1. Compressor 4 includes housing 6 which defines an interior region 8 at discharge pressure and receives suction or inlet conduit 10 and discharge or outlet conduit 12. Compressing mechanism 14 is disposed within interior region 8, and is in fluid communication with suction conduit 10 and discharge conduit 12. A drive mechanism is also disposed within interior region 8, the driving mechanism comprising a motor (not shown) and crankshaft 16. The driving mechanism disclosed in the aforementioned U.S. Pat. No. 4,875,838, and many other well known driving mechanisms, can be used.

Compressing mechanism 14 has an Oldham-type arrangement for compressing refrigerant. Fixed pump body 18 is fixedly secured to housing 6, and is in fluid communication with inlet 10. Orbiting plate 20 abuts pump body 18 to define compressing chamber 22 within walls 24 and 26 of pump body 18 (See FIG. 2). Pump body 18 provides suction port 28 which is connected to suction inlet 10, and also provides discharge ports 30 which are fluidly connected to interior region 8. Within chamber 22, Oldham-type piston 32 is slidably disposed to reciprocate when orbiting plate 20 orbits.

Orbiting plate 20 is eccentrically and rotatably connected to crankshaft 16 and is supported by thrust plate 34 for driving the orbiting movement. Thrust plate 34 is attached to an end of crankshaft 16 and includes eccentric 36, which is eccentrically positioned with respect to the axis of rotation of crankshaft 16. Sleeve portion 38 of orbiting plate 20 rotatably engages eccentric 36. The rotatable engagement of eccentric 36 and sleeve 38 is facilitated by lubrication or by an additional bearing sleeve (not shown).

In accordance with the present invention, piston 32 includes a T-shaped inner passage 40 which allows refrigerant to flow from inlet 10 into chamber 22. Central portion 42 of passage 40 opens into suction chamber 44 which is a space defined by piston 32 and body 18, with chamber 44 being in fluid communication with inlet 10. Suction chamber 44 is sufficiently elongated so that inlet conduit 10 remains in flu communication with central portion 42 during the entire range of reciprocating movement of piston 32. Suction leaf valves 46 are disposed on the port ends 47 of base portion 48 of passage 40 to selectively allow refrigerant to enter chamber 22. At least one suction leaf valve 46 is disposed on each side of piston 32 so that the opposite portions of chamber 22 are fluidly coupled to passage 40. Attached over discharge ports 30 at the outer periphery of chamber 22 are discharge leaf valves 50 which selectively allow compressed refrigerant to enter interior region 8.

Piston 32 also includes tabs 52 which extend downwardly into slots 54 of orbiting plate 20. Slots 54 are oriented perpendicular with respect to parallel sidewalls 24 of body 14. Slots 54 are keyed to tabs 52 in one direction and slide relative to tabs 52 in the orthogonal direction in order to convert the orbiting motion of plate 20 to the sliding motion piston 32. In the preferred embodiment, piston 32 has a square block shape and chamber 22 has a rectangular block shape.

Figure 2:
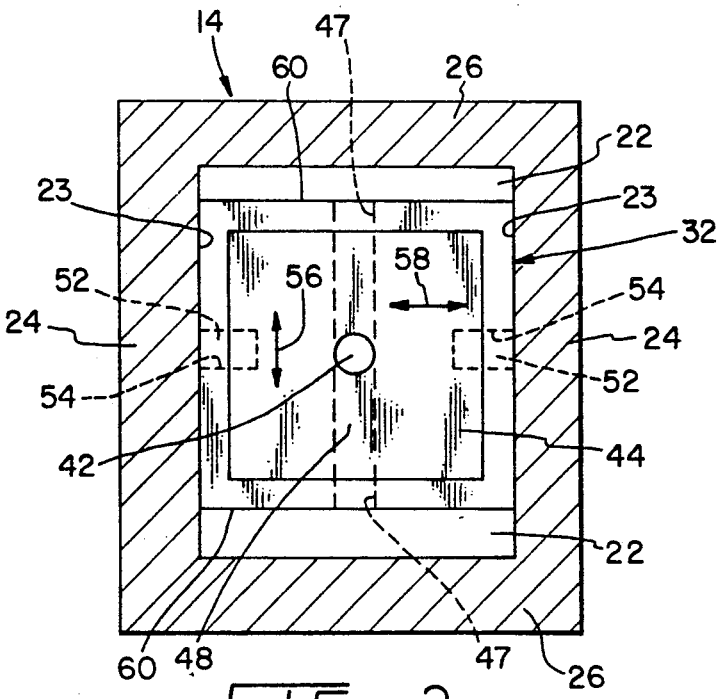
FIG. 2 is a top plan view of the Oldham-type mechanism of FIG. 1.

In operation, crankshaft 16 drives compressing mechanism 14 by causing orbiting plate 20 to orbit. When crankshaft 16 rotates, eccentric 36 moves orbiting plate 20 and the connection of tabs 52 with slots 54 and piston 32 with parallel sidewalls 24 translates the rotary motion to an orbiting motion. Referring to FIG. 2, piston 32 follows the component of the orbiting motion oriented in first direction 56, but cannot follow the component of the orbiting motion oriented in second direction 58 because of fixed sidewalls 24 of body 14. Thus, piston 32 reciprocates within chamber 22 in first direction 56 with suction leaf valves 46 allowing refrigerant to enter chamber 22 to be compressed by piston 32 then discharged throu discharge leaf valves 50.

Piston 32 has facing walls 60 which sealingly interface with the inner surfaces 23 of pump body 18 and orbiting plate 20 so that refrigerant in chamber 22 can be effectively compressed. To minimize frictional resistance to the reciprocation motion of piston 32, inlet chamber 44 and chamber 62, which faces orbit plate 20, are defined by recesses in piston 32 so that a minimum amount of the enter piston 32 abuts the inner surfaces of pump b ting plate 20 and an oil pocket is formed.

The foregoing discussion discloses the use of the present invention with a high pressure hermetic housing. In addition, the present invention is fully compatible with a low pressure hermetic housing. Minor changes to the exemplary embodiment can illustrate the compatibility. For example, the discharge ports can be directly coupled to the discharge line, and the inlet port can be coupled to the interior of the hermetic housing. In this manner, the present invention may be used in a low pressure housing.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A compressor comprising:

a hermetically sealed housing including an inlet and an outlet;

an orbiting plate disposed within said housing;

driving means for causing said orbiting plate to orbit;

a compressing chamber fixedly attached to said housing;

piston means for compressing refrigerant in said compressing chamber, said piston means slidably engaging said orbiting plate for relative rectilinear movement in a first direction, said piston means disposed within said compressing chamber and movable within said compressing chamber in a second direction, said second direction being perpendicular to said first direction, said orbiting plate being sealingly engaged with said compressing chamber and said piston means, said piston means being keyed to said orbiting plate to be driven by said orbiting plate in said second direction, so that said piston means moves in said second direction to thereby cause compression of refrigerant fluid when said driving means causes said orbiting plate to orbit;

first valve means for selectively providing fluid communication between said inlet and said piston means; and second valve means for selectively providing fluid communication between said piston means and said outlet.

2. The compressor of claim 1 wherein said piston means comprises an Oldham mechanism.

3. The compressor of claim 2 wherein said piston means includes an inner passage in fluid communication with said inlet.

4. The compressor of claim 3 wherein said inner passage includes two port ends in communication with opposite portions of said compressing chamber.

5. The compressor of claim 4 wherein each said port end includes a leaf valve for selectively providing fluid communication through said leaf valve.

6. The compressor of claim 3 wherein said inner passage has a T-shape including a base portion in communication with said inlet.

7. The compressor of claim 3 wherein said first valve means includes a suction leaf valve disposed between said inner passage and said compressing chamber.

8. The compressor of claim 1 wherein said second valve means includes a discharge leaf valve disposed between said compressing chamber and an interior region of said housing.

9. The compressor of claim 1 wherein said compressing chamber includes two oppositely located discharge ports, and said second valve means includes two discharge leaf valves located on a respective one of said discharge ports.

10. The compressor of claim 1 wherein said orbiting plate includes one of a tab and slot oriented in said first direction, and said piston means includes the other of a tab and slot, said tab extending into said slot.

11. The compressor of claim 1 wherein said orbiting plate includes two slots oriented in said first direction, and said piston means includes two tabs, each said tab extending into a respective said slot.

12. The compressor of claim 10 wherein said compressing chamber includes two generally parallel side walls for guiding movement of said piston means in said second direction.

13. The compressor of claim 3 wherein said compressing chamber and said piston means define a suction chamber, said suction chamber is in fluid communication with said inner passage and said inlet, and said suction chamber is elongated in said second direction whereby said suction chamber remains in fluid communication with said inlet during movement of said piston means.

14. The compressor of claim 1 wherein said driving means includes a crankshaft having a thrust plate with an eccentric, and said orbiting plate includes a sleeve rotatably disposed on said eccentric.

15. A high pressure hermetic compressor comprising:

a hermetically sealed housing including an inlet, an outlet, and an interior region;

a crankshaft rotatably disposed within said housing;

an orbiting plate rotatably attached to said crankshaft at an eccentric position relative the axis of rotation of said crankshaft;

a pump body fixedly attached to said housing, said pump body and said orbiting plate defining a compressing chamber, said compressing chamber being at a relatively low pressure in relation to the pressure of said interior region, said orbiting plate sealingly engaging said pump body;

a piston comprising an Oldham mechanism having a portion slidably engaging said orbiting plate in a fist direction, said piston disposed within said pump body and movable within said pump body in a second direction, said second direction being perpendicular to said first direction, said piston being keyed to said orbiting plate to be driven by said orbiting plate in said second direction so that said piston moves in said second direction when said crankshaft rotates and causes said orbiting plate to orbit, said piston being sealingly engaged with said pump body and said orbiting plate to thereby cause compression of refrigerant fluid during movement of said piston in said second direction;

first valve means for selectively providing fluid communication between said inlet and said compressing chamber; and second valve means for selectively providing fluid communication between said compressing chamber and said outlet.

16. The compressor of claim 15 wherein said piston includes an inner passage in fluid communication with said inlet.

17. The compressor of claim 16 wherein said inner passage includes tow port ends in communication with opposite portions of said compressing chamber.

18. The compressor of claim 17 wherein each said port end includes a leaf valve for selectively providing fluid communication through said leaf valve.

19. The compressor of claim 16 wherein said inner passage has a T-shape including a base portion in communication with said compressing chamber and a central portion in communication with said inlet.

20. The compressor of claim 16 wherein said first valve means includes a suction leaf valve disposed between said inner passage and said compressing chamber.

21. The compressor of claim 15 wherein said second valve means includes a discharge leave valve disposed between said compressing chamber and said interior region.

22. The compressor of claim 15 wherein said compressing chamber includes two oppositely located discharge ports, and said second valve means includes two discharge leaf valves located on a respective one of said discharge ports.

23. The compressor of claim 15 wherein said orbiting plate includes one of a tab and slot oriented in said first direction, and said piston includes the other of a tab and slot, said tab extending into said slot.

24. The compressor of claim 15 wherein said orbiting plate includes two slots oriented in said first direction, and said piston includes two tabs, each said tab extending into a respective said slot.

25. The compressor of claim 24 wherein said pump body includes two generally parallel side walls for guiding movement of said piston in said second direction.

26. The compressor of claim 16 wherein said compressing chamber and said piston define a suction chamber, said suction chamber is in fluid communication with said inner passage and said inlet, an said suction chamber is elongated in said second direction whereby said suction chamber remains in fluid communication with said inlet during movement of said piston.

27. The compressor of claim 15 wherein said pump body includes two generally parallel said walls for guiding movement of said piston in said second direction.

28. The compressor of claim 15 wherein said crankshaft includes a thrust plate with an eccentric, and said orbiting plate includes a sleeve rotatably disposed on said eccentric.

* * * * *

UNITED STATES PATENT AND TRADEMARK OFFICE

CERTIFICATE OF CORRECTION

PATENT NO. : 5,131,824

DATED : July 21, 1992

INVENTOR(S) : Hubert Richardson, Jr. and George W. Gatecliff

It is certified that error appears in the above-identified patent and that said Letters Patent is hereby corrected as shown below:

Claim 6, Column 4, Line 46, Before "inlet" insert --compressing chamber and a central portion in communication with said--.

Claim 15, Column 5, Line 33, Change "fist" to --first--.

Claim 21, Column 6, Line 19, Change "leave" to --leaf--.

Signed and Sealed this

Fourteenth Day of September, 1993

Bruce Lehman

*Attest:*

BRUCE LEHMAN

*Attesting Officer*

*Commissioner of Patents and Trademarks*